US006648683B2

(12) United States Patent
Youtsey

(10) Patent No.: US 6,648,683 B2
(45) Date of Patent: Nov. 18, 2003

(54) QUICK CONNECTOR FOR A COAXIAL CABLE

(76) Inventor: Timothy L. Youtsey, 1715 W. Sunrise Blvd., Gilbert, AZ (US) 85233

( * ) Notice: Subject to any disclaimer, the term of this patent is extended or adjusted under 35 U.S.C. 154(b) by 0 days.

(21) Appl. No.: 10/135,389

(22) Filed: May 1, 2002

(65) Prior Publication Data

US 2002/0164900 A1 Nov. 7, 2002

Related U.S. Application Data

(60) Provisional application No. 60/288,091, filed on May 3, 2001.

(51) Int. Cl.[7] ..... H01R 9/05

(52) U.S. Cl. ..... 439/578; 439/610

(58) Field of Search ..... 439/578, 610, 439/99, 299, 310, 345, 373, 903, 328; 174/89, 75 C

(56) References Cited

U.S. PATENT DOCUMENTS

| | | | | | |
|---|---|---|---|---|---|
| 3,275,737 | A | * | 9/1966 | Caller | 174/89 |
| 3,344,227 | A | * | 9/1967 | Gilmartin et al. | 174/88 C |
| 3,366,920 | A | | 1/1968 | Laudig et al. | |
| 3,489,988 | A | | 1/1970 | Carnaghan | |
| 3,544,705 | A | * | 12/1970 | Winston | 174/75 C |
| 3,609,651 | A | * | 9/1971 | Sladek et al. | 29/867 |
| 3,653,689 | A | * | 4/1972 | Sapy et al. | 285/113 |
| 3,708,781 | A | * | 1/1973 | Trompeter | 439/584 |
| 3,740,453 | A | | 6/1973 | Callaghan et al. | |
| 3,836,700 | A | * | 9/1974 | Niemeyer | 174/89 |
| 4,225,162 | A | * | 9/1980 | Dola | 285/139.1 |
| 4,408,822 | A | * | 10/1983 | Nikitas | 439/583 |
| 4,718,854 | A | | 1/1988 | Capp et al. | |
| 5,083,943 | A | | 1/1992 | Tarrant | |
| 5,123,863 | A | | 6/1992 | Frederick et al. | |
| 5,145,382 | A | | 9/1992 | Dickirson | |
| 5,161,993 | A | | 11/1992 | Leibfried | |
| 5,195,910 | A | | 3/1993 | Enomoto et al. | |
| 5,295,864 | A | * | 3/1994 | Birch et al. | 439/578 |
| 5,318,458 | A | * | 6/1994 | Thorner | 439/427 |
| 5,470,257 | A | * | 11/1995 | Szegda | 439/578 |
| 5,498,175 | A | | 3/1996 | Yeh et al. | |
| 5,525,076 | A | * | 6/1996 | Down | 439/585 |
| 5,632,651 | A | * | 5/1997 | Szegda | 439/578 |
| 5,667,409 | A | | 9/1997 | Wong et al. | |
| 5,927,975 | A | * | 7/1999 | Esrock | 433/80 |
| 6,140,582 | A | * | 10/2000 | Sheehan | 174/65 G |
| 6,142,788 | A | | 11/2000 | Han | |
| 6,146,196 | A | | 11/2000 | Burger et al. | |
| 6,174,206 | B1 | * | 1/2001 | Yentile et al. | 439/638 |
| 6,183,297 | B1 | | 2/2001 | Kay et al. | |
| 6,183,298 | B1 | | 2/2001 | Henningsen | |
| 6,210,221 | B1 | * | 4/2001 | Maury | 439/578 |
| 6,210,222 | B1 | | 4/2001 | Langham et al. | |

FOREIGN PATENT DOCUMENTS

| | | |
|---|---|---|
| GB | 2079549 | 1/1982 |
| JP | 05-347170 | 12/1993 |
| WO | 93/10578 | 5/1993 |

* cited by examiner

*Primary Examiner*—Tho D. Ta
*Assistant Examiner*—Larisa Tsukerman
(74) *Attorney, Agent, or Firm*—Richard C. Litman

(57) ABSTRACT

A quick connector for securing a coaxial cable to an electronic device (cable splitter, VCR, monitor, etc.) is formed integrally with the device. The connector has a cylindrical housing extending from the structure of the electronic device, with a generally tubular inner body and collar permanently and immovably affixed within the housing. The only movable component is a retainer having a series of fingers which selectively grip a corresponding circumferential groove inside the collar. A coaxial cable is trimmed to expose the center conductor, a portion of the outer cover is removed, and the shielding is folded back. The cable is inserted into the connector, with the barbed end of the inner body penetrating between the cable dielectric and shielding. The cable and retainer are then withdrawn slightly to force the retainer fingers against the cable outer cover and shielding to capture them between the retainer fingers and inner body.

20 Claims, 4 Drawing Sheets

QUICK CONNECTOR FOR A COAXIAL CABLE

REFERENCE TO RELATED PATENT APPLICATION

This application claims the benefit of U.S. patent application Ser. No. 60/288,091, filed on May 3, 2001.

BACKGROUND OF THE INVENTION

1. Field of the Invention

The present invention relates generally to electrical connectors, and more specifically to a coaxial cable connector which is integrated with the device to which the cable is to be connected. The present quick connector requires only trimming of the coaxial cable end, whereupon the cable end is inserted into the connector and manipulated to lock it in place. The cable connection process provided by the present invention needs no tools once the cable end has been prepared, and is completely reversible.

2. Description of Related Art

Coaxial cable is commonly used for carrying electromagnetic signals in various environments. Such cable generally comprises a relatively thin and lightweight conductor surrounded circumferentially by a dielectric insulating material, with a braid or screen electrical shield therearound and an electrically insulating cover covering the shielding braid.

Such coaxial cable is commonly used for the local transmission of video signals from an incoming line or signal generator (computer, etc.) for cable and satellite television receivers, computer monitors, etc. The cable ends are prepared to expose the fine concentric conductor wire therein, and are conventionally assembled with various fittings which are crimped or otherwise attached to the cable end and then installed into a cooperating fitting on the device to which the cable is to be connected.

Certain standards for compatibility of fittings, tools used for assembly, etc. have been developed over the years. However, all of the various standards of which the present inventor is aware, require various tools for the preparation of the coaxial cable end and/or fitting to be installed upon the electrical component to which the cable is to be connected, or require relatively complex assembly of various small components at the electrical component and/or cable end. These requirements result in considerable cost for the various connecting components and hardware, the tools involved (crimping tools, etc.), and also the cost of the additional time involved by the technician to assemble the fittings and install the cable.

Accordingly, a need will be seen for a quick connector for coaxial cable, which includes all of the connector componentry in an integral assembly with the electrical device to which the cable is to be connected. The device must require only trimming of the cable end, with connection achieved by inserting the cut cable end into the connector.

A discussion of the related art of which the present inventor is aware, and its differences and distinctions from the present invention, is provided below.

U.S. Pat. No. 3,366,920 issued on Jan. 30, 1968 to Ronald C. Laudig et al., titled "Coaxial Connector," describes a relatively complex assembly for connecting two separate lengths of coaxial cable together. The Laudig et al. assembly requires that a series of components be permanently crimped in place upon each cable end, with the cable ends terminating in mating male and female connectors which are plugged together. The Laudig et al. connecting means requires considerable componentry and a relatively large amount of labor time for assembly, as well as various crimping and other tools for fabrication and assembly. In contrast, the present quick connector is provided preassembled with the electronic device at the time of manufacture, and requires no additional tools or labor for fabrication.

U.S. Pat. No. 3,489,988 issued on Jan. 13, 1970 to Luason L. Carnaghan, titled "In-Line Cable Connectors," describes a relatively complex assembly of components which are field assembled to each of the ends of two mating coaxial cables to join the cables together. A third component is used between the two cable ends, even though the two cable ends comprise male-female connector pin means. The result is a complex assembly which requires a relatively large amount of time to assemble in the field, and which is not adaptable for use in connecting a cable end to a non-cable receptacle, in any event.

U.S. Pat. No. 3,740,453 issued on Jun. 19, 1973 to John D., Callaghan et al., titled "Adapter For Coaxial Cable Connector," describes a cable connector assembly comprising an F-56 connector and an adapter for connecting either relatively larger diameter RG6/U coaxial cable, or smaller diameter RG59/U cable thereto. The Callaghan et al. adapter essentially comprises a sleeve which fits into the larger diameter receptacle of the F-56 connector, to adapt the connector for the smaller diameter RG59/U cable. Both the F-56 connector and the Callaghan et al. adapter include a barbed end for working between the dielectric and the outer conductor or shield, but the use of a conventional connector by Callaghan et al. requires that the connector be crimped about the outer diameter of the coaxial cable, unlike the present assembly. Moreover, Callaghan et al. require separate attachment of the conventional F56 connector to the electrical component to which the cable is to be connected, whereas the present connector is manufactured integrally with the electrical component.

U.S. Pat. No. 4,718,854 issued on Jan. 12, 1988 to Randolph E. Capp et al., titled "Low Profile Press Fit Connector," describes a complex assembly comprising a conventional factory formed cable end and a socket therefor, for installing on a circuit board or the like. The Capp et al. socket cannot accept a bare coaxial cable end which has been trimmed for installation, as provided by the present quick connector invention. Moreover, the Capp et al. socket is not an integral part of an electrical or cable component, but rather must be installed thereon in the field.

U.S. Pat. No. 5,083,943 issued on Jan. 28, 1992 to Dennis E. Tarrant, titled "CATV Environmental F-Connector," describes a coaxial cable end connector assembly which is swaged or crimped in place, with an attachment nut captured on the end of the connector assembly. The crimping requirement results in tools being required for the assembly, whereas a coaxial cable can be installed in the present connector with no tools being required, other than a knife or other cutting tool for cutting back the outer cover and exposing the central conductor. Moreover, the Tarrant assembly requires a mating male threaded connector on the cable receptacle structure to which the cable is to be connected, whereas the present connector is formed integrally with the cable receptacle structure and the cable itself is devoid of specialized attachment means.

U.S. Pat. No. 5,123,863 issued on Jun. 23, 1992 to Albert H. Frederick et al., titled "Solderless Housing Interconnect For Miniature Semi-Rigid Coaxial Cable," describes an assembly having a threaded sleeve which installs in a structure to hold a coaxial cable in place. The cable must be fabricated with the appropriate components, i.e., the threaded sleeve must be installed on the cable and a retainer soldered in place (contrary to the title of the patent) on the outer conductor of the cable, before installing the cable end. The need for tools (soldering iron or gun and tool for driving the threaded retainer) result in a considerably more labor intensive installation than that achieved by the present quick connector invention.

U.S. Pat. No. 5,145,382 issued on Sep. 8, 1992 to David M. Dickirson, titled "Molded Plastic Surface-Mountable Coaxial Connector," describes a socket having a plated, electrically conductive contact surface for conducting electrical energy from the outer conductor or shield of a coaxial cable, to the printed circuit board. The Dickirson connector is not manufactured as a part of the circuit board, but is assembled therewith in the field, unlike the present quick connector invention. The means for securing the cable in the Dickirson connector, i.e., engaging a circumferential port with a tab cut from the outer conductor or shielding of the cable, is unlike that used with the present coaxial cable connector invention.

U.S. Pat. No. 5,161,993 issued on Nov. 10, 1992 to Richard G. Leibfried, Jr., titled "Retention Sleeve For Coupling Nut For Coaxial Cable Connector And Method For Applying Same," describes a multi-piece coaxial cable terminal assembly, involving the swaging or crimping of various components to the cable end. Leibfried, Jr. also requires that a threaded nut be installed on the assembly before finally crimping the assembly in place on the cable, thereby capturing the nut on the end of the terminal assembly. The nut is used to secure the assembly to a separate electronic device. In contrast, the present quick connector invention is an integral, permanent part of the electronic device itself, rather than being a part of the cable. The present invention does not require any additional components to be secured to the cable end, but only that the cable end be properly trimmed.

U.S. Pat. No. 5,195,910 issued on Mar. 23, 1993 to Hideyuki Enomoto et al., titled "Coaxial Connector," describes a connector in which solder is used to bond the shielding braid of the coaxial cable to the inner surface of the tubular connector. A coupling nut is installed upon the connector before assembly of the connector to the cable. Enomoto et al. attach the cable connector means to the end of the cable, rather than to the electronic device to which the cable is to be connected, as in the present quick connector invention. The Enomoto et al. connector assembly is thus more closely related to the connector of the Leibfried, Jr. '993 U.S. patent discussed immediately above, than to the present quick connector invention.

U.S. Pat. No. 5,498,175 issued on Mar. 12, 1996 to Ming-Hwa Yeh et al., titled "Coaxial Cable Connector," describes an inline connector for connecting two separate lengths of coaxial cable. The two connecting components which attach to the respective cable ends are essentially symmetrical, with a single electrically conductive contact extending therebetween. A threaded outer sleeve surrounds the conductor, with capture nuts securing each of the connectors to the threaded sleeve. An asymmetrical embodiment is also illustrated in FIG. 6 of the '175 U.S. patent, for connecting a coaxial cable to a circuit board or the like. However, none of these devices are provided as integral components of an electrical device (VCR, cable box, television set, monitor, signal splitter, etc.) into which the bare end of a coaxial cable may be installed, as provided by the present quick connector.

U.S. Pat. No. 5,667,409 issued on Sep. 16, 1997 to Shen-Chia Wong et al., titled "Structure Improvement For The Connector Of Coaxial Cable," describes a central connector element having specifically stamped inwardly protruding tabs for contact with the central conductor pins of joined coaxial cable ends. One embodiment (FIG. 9) illustrates a connector and coupling for installation to another object (circuit board, etc.), rather than connecting two cable ends together. The same points noted above in the discussion of the Yeh et al. '175 U.S. patent are seen to apply here as well, as the two disclosures of the '175 and '409 U.S. patents are closely related.

U.S. Pat. No. 6,142,788 issued on Nov. 7, 2000 to Sang-Hyun Han, titled "Cable Connector And Monitor Equipped With The Same," describes a connector assembly for connecting a coaxial cable to the circuit board of a computer monitor or the like. The Han connector locks into a retaining panel by means of a capture nut, and includes a male pin for engaging a printed circuit board behind the retaining panel. The opposite end of the Han connector has a socket for receiving a cooperating pin from a previously fabricated adapter end on a coaxial cable. The Han connector requires that the cable be provided with a mating bayonet type end connector, in order to secure the coaxial cable end to the Han connector. A coaxial cable with no additional attachment means secured thereto, cannot mate with the Han connector. Moreover, the Han connector is not an integral part of the electronic device with which it is installed, as is the present quick connector invention.

U.S. Pat. No. 6,146,196 issued on Nov. 14, 2000 to Edward W. Burger et al., titled "Mated Coaxial Contact System," describes a connector for connecting two lengths of coaxial cable together. The Burger et al. connector requires that mating pin and socket fittings be mechanically crimped to the central conductors of the respective two cables, and that their circumferential braided shielding be soldered to a shielding sleeve of the connector. In contrast, the present quick connector requires only that the various components of the cable be cut to length, and then inserted into the connector. It should also be noted that the present connector is an integral component of the electrical device to which the cable is being connected, unlike the cable-to-cable connector of the Burger '196 U.S. patent.

U.S. Pat. No. 6,183,297 issued on Feb. 6, 2001 to Gregory L. Kay et al., titled "Coaxial Connector," describes a device for using a coaxial cable as a conductor for hanging electrical lighting. The Kay et al. connector includes a restriction therein, which peels back the outermost cover and, braided shielding over a portion of the cable. A pair of screws are used to clamp the coaxial cable in place, with the screws penetrating the outer and inner insulation to make electrical contact with the respective underlying conductors. While no special fittings need first be applied to the cable used with the Kay et al. connector, Kay et al. do not disclose any integration of their connector with an electronic device of any sort, as provided by the present quick connector invention.

U.S. Pat. No. 6,183,298 issued on Feb. 6, 2001 to Jimmy C. Henningsen, titled "Connector For Coaxial Cable With Friction Locking Arrangement," describes a cable end fitting in which a cut, bare cable end is inserted in the fitting and mating threaded components are tightened to grip the cable and exposed central conductor of the cable in a permanent installation. An attachment nut is captured on the end of the assembly, for attaching the device to an electrical component. The Henningsen device differs considerably from the present quick connector in that the Henningsen device attaches permanently to the cable end and is removably attachable to the electrical device, whereas the present connector is an integrally formed, permanent part of the electrical device and the cable is removably secured therein. Moreover, the present quick connector does not require tools for installing the cable to the connector, as required by Henningsen.

U.S. Pat. No. 6,210,222 issued on Apr. 3, 2001 to Arvin L. Langham et al., titled "Coaxial Cable Connector," describes an F-type connector (e.g., F56, etc.) for permanent installation to the end of a coaxial cable. The Langham et al. connector becomes a part of the cable, rather than being formed integrally with the electronic component at the time of manufacture, as is the case with the present quick connector. Langham et al. include a threaded nut at the end of their connector, for removably attaching their connector (and the coaxial cable end therein) to another electronic device. The Langham et al. connector requires at least a wrench, whereas the present quick connector requires no tools.

British Patent Publication No. 2,079,549 published on Jan. 20, 1982 to Christopher W. Tyree, titled "Coaxial Cable Connector," describes a connector assembly adapted for permanent installation to the end of a coaxial cable, rather than being an integral part of the electrical device to which the cable is attached, as is the case in the present invention. The Tyree connector includes a component which penetrates between the inner dielectric and the electrically conductive shielding thereover, as is the case with the present quick connector. However, the Tyree assembly appears to be permanently installed, as no means is disclosed for removal of the connector from the cable without damage to the cable. The present quick connector includes means for removal of the coaxial cable from the connector, as the connector is a permanent part of the electrical device to which the cable is to be connected.

International Patent Publication No. 93/10,578 published on May 27, 1993 to ITT Electromechanical Components Worldwide, titled "Coaxial Connector," describes another connector permanently attached to the end of the coaxial cable itself, rather than being formed as a part of the electronic device to which the cable removably attaches, as in the case of the present quick connector invention. The ITT device crimps about the folded back outer conductor braid to secure the cable within the connector, with an elongate nose and female connector extending from the central conductor of the coaxial cable. The ITT device requires extensive tooling for assembly to the cable, and means must still be provided for removable attachment of the ITT device to an electronic device.

Finally, Japanese Patent Publication No. 40-5,347,170 published on Dec. 27, 1993 to Japan Aviation Electron Ind. Ltd., titled "Coaxial Connector," describes (according to the English abstract and drawings) a coaxial cable end connector for permanent installation to the end of a cable. The Japanese cable end connector essentially comprises a central contact which is secured to the central conductor of the coaxial cable, with a ferrule extending over the outer cable. The outer cover is cut back and the shielding braid is folded back over the outer cover before installing the ferrule. Tabs from the ferrule are then bent inwardly to contact the folded back shielding braid. The Japanese connector thus becomes a permanent part of the cable end and cannot be removed therefrom, rather than being an integral part of the electronic device to which the cable attaches and permitting removal of the cable, as provided by the present quick connector.

None of the above inventions and patents, either singly or in combination, is seen to describe the instant invention as claimed.

SUMMARY OF THE INVENTION

The present invention comprises a quick connector for coaxial cable, with the present connector being an integral part of the electronic device to which the cable is to be connected. The coaxial cable itself remains free of any connector hardware, and the installation of the cable into the connector requires only that the cable end be trimmed for proper fit. No tools are required for installing the cable end into the present quick connector.

The present quick connector comprises a housing formed as an integral part of the case or shell of the electronic component to which the coaxial cable is to be attached. A generally tubular inner body portion is permanently installed in the housing extending from the case of the electronic device. The inner body has a relatively sharp edge with a diameter substantially equal to that of the dielectric of the coaxial cable, and serves to separate the shielding braid from the dielectric by driving between the two when the cable is pushed into the connector. A collar is also permanently installed within the housing, with the diameter of the collar providing a press fit within the outer end of the housing.

The only movable component of the device, is a generally cylindrical retainer having a series of fingers extending generally axially therefrom. Each finger includes an outwardly extending ridge, forming a generally circumferential ridge series extending around the retainer. The ridges selectively engage a corresponding groove formed within the collar, which is in turn press fit into the housing. Once the coaxial cable has been trimmed as required, with the central conductor exposed, the outer cover cut back, and the shielding braid folded back over the outer cover, the cable is inserted through the open end of the retainer to engage the edge of the inner body. When the cable has been forced into the connector a sufficient depth, the cable and retainer are pulled outwardly slightly, whereupon the cable outer cover and shielding are captured between the inwardly deflected retainer fingers and inner body of the device to hold the cable in place.

The above structure also permits the cable to be withdrawn from the connector, as desired. The cable installation in the present connector is by no means permanent, unless permanent retention of the cable end in the connector is desired. Withdrawal of the cable from the connector is accomplished essentially by reversing the installation, i.e., pushing in the flange of the retainer to release the lateral pressure on the folded shielding and outer cover, momentarily pushing the cable into the connector to release the hold of the barbs of the inner body end on the cable, and then withdrawing the cable from the connector. Disconnection and reconnection of the cable from and to the connector may be made as many times as desired, with no tools being required other than cutting tools for the initial trimming of the cable end.

Accordingly, it is a principal object of the invention to provide a quick connector for connecting a coaxial cable to an electronic device.

It is another object of the invention to form the quick connector as an integral component of the electronic device.

It is a further object of the invention to provide a quick connector assembly which requires no additional structural attachments to the coaxial cable and no tools for installation or removal of the cable from the connector.

Still another object of the invention is to provide a quick connector for coaxial cable, which permits the cable to be removed and reinstalled upon the connector any number of times as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
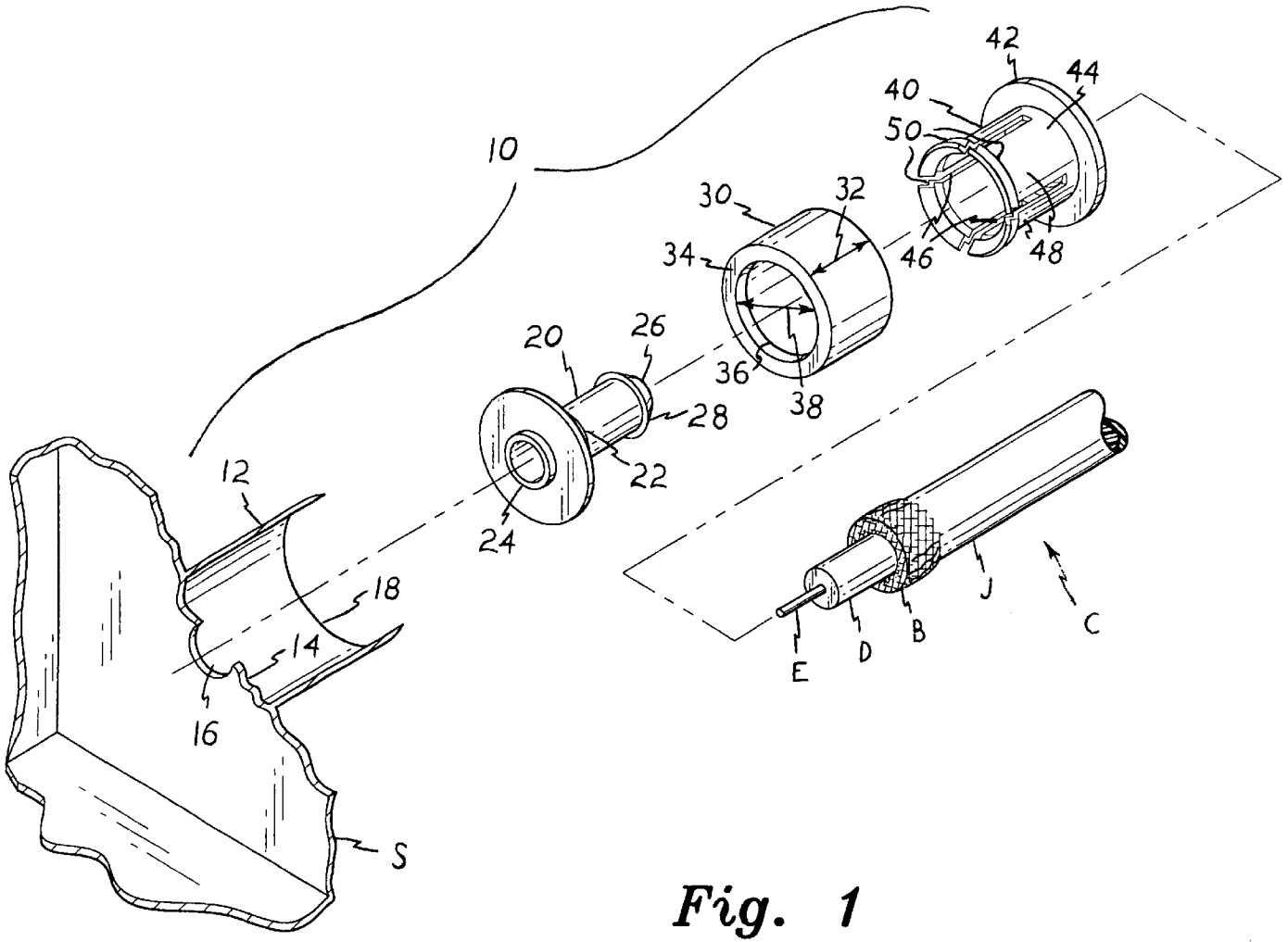
FIG. 1 is an exploded perspective view of the various components comprising the quick connector for a coaxial cable according to the present invention, and a coaxial cable which has been trimmed for installation in the present quick connector.

The present invention is a quick connector for removably connecting the bare trimmed end of a coaxial cable to an electronic device adapted for receiving signals by means of the cable. Such electronic devices include, but are not limited to, television sets, computer monitors, video cassette recorders (VCRs), cable and satellite television receivers and control systems, and signal splitters for use with such devices, with such coaxial cable connected devices and the coaxial cable used to provide signals thereto being conventional. The present quick connector, designated by the reference numeral 10 throughout the drawings, requires no tools or equipment for connecting a coaxial cable thereto, once the cable end has been cut and trimmed as required.

FIG. 1 provides an exploded perspective view of the basic components comprising the present quick connector 10. Three of the connector components are housed in a generally cylindrical outer housing 12, which extends from the outer shell S or case of the conventional electronic device to which the coaxial cable C is to be installed. The housing 12 is preferably formed as an integral component of the electronic device case or shell S, and may be cast or otherwise formed concurrently with the manufacture of the electronic device case or shell S of the same materials (preferably an electrically conductive material) at the time of manufacture of the electronic device. Alternatively, the quick connector housing 12 may be mechanically or otherwise permanently affixed to the shell S of the electronic device at the time of manufacture.

The housing 12 has an electronic device end wall 14, in common with the shell S of the electronic device from which the housing 12 extends. A cable passage 16 is formed through the end wall 14, to allow the end of the coaxial cable C to pass into the shell S of the electronic device. (This passage 16 is of a somewhat larger diameter than the diameter of the portion of the coaxial cable C passing therethrough, for reasons explained further below.) The opposite cable insertion end 18 of the cylindrical connector housing 12 is open, for installing the other connector components therein and for insertion of the coaxial cable C therein.

A generally tubular inner body element 20 is permanently installed and immovably affixed concentrically within the outer housing 12. The internal diameter of the inner body 20 tube is essentially equal to the diameter of the coaxial cable dielectric, as described further below. The inner body 20 has a conically shaped, wider end portion 22 at the end wall attachment end thereof, with an end flange 24 extending from the base of the conical electronic device attachment end 22. The end flange 24 has an outer diameter formed to provide a secure press fit into the cable passage 16 of the wall of the shell S of the electronic device, thereby holding and securing the inner body element 20 permanently and immovably in place within the cylindrical housing 12. The opposite coaxial cable engagement end 26 of the tubular body 20 terminates in a circumferential sharpened edge for engaging the coaxial cable, with a circumferential barb 28 extending around the tubular body 20 adjacent the sharpened cable engagement end 26.

A generally cylindrical collar 30 is press fit into the open housing end 18 after the inner body 20 has been installed therein. The collar 30 has an outer diameter formed to fit tightly into the housing inner diameter, thereby providing a permanent and immovable installation for the collar 30 within the housing 12. The length 32 of the collar 30 is considerably shorter than the length of the housing 12, extending from the open end 18 of the housing 12 only about half the housing length. The inwardly positioned end 34 of the collar 30 has a circumferential groove 36 formed in the inner diameter 38 thereof for selectively engaging the finger ridges of the retainer element, as described below.

The housing 12, inner body 20, and collar 30, are immovably secured in place relative to one another and form an essentially monolithic structure. However, an axially displaceable retainer 40 is installed concentrically within the collar 30 at the open end 18 of the outer housing 12. The retainer 40 engages both the outer surface of the coaxial cable C and the groove 36 of the collar 30, to lock the coaxial cable C in place within the connector 10 during cable installation. The retainer 40 essentially comprises an external circular flange 42, with a generally cylindrical sleeve 44 extending therefrom (toward the housing end wall 14). The sleeve 44 includes a series of axially parallel slots 46, separating the sleeve 44 into a corresponding series of radially flexible fingers 48 extending from the retainer flange 42. The fingers 48 each include a circumferential, outwardly disposed ridge 50 extending thereacross, for engaging the collar groove 36 as described below.

Figure 2:
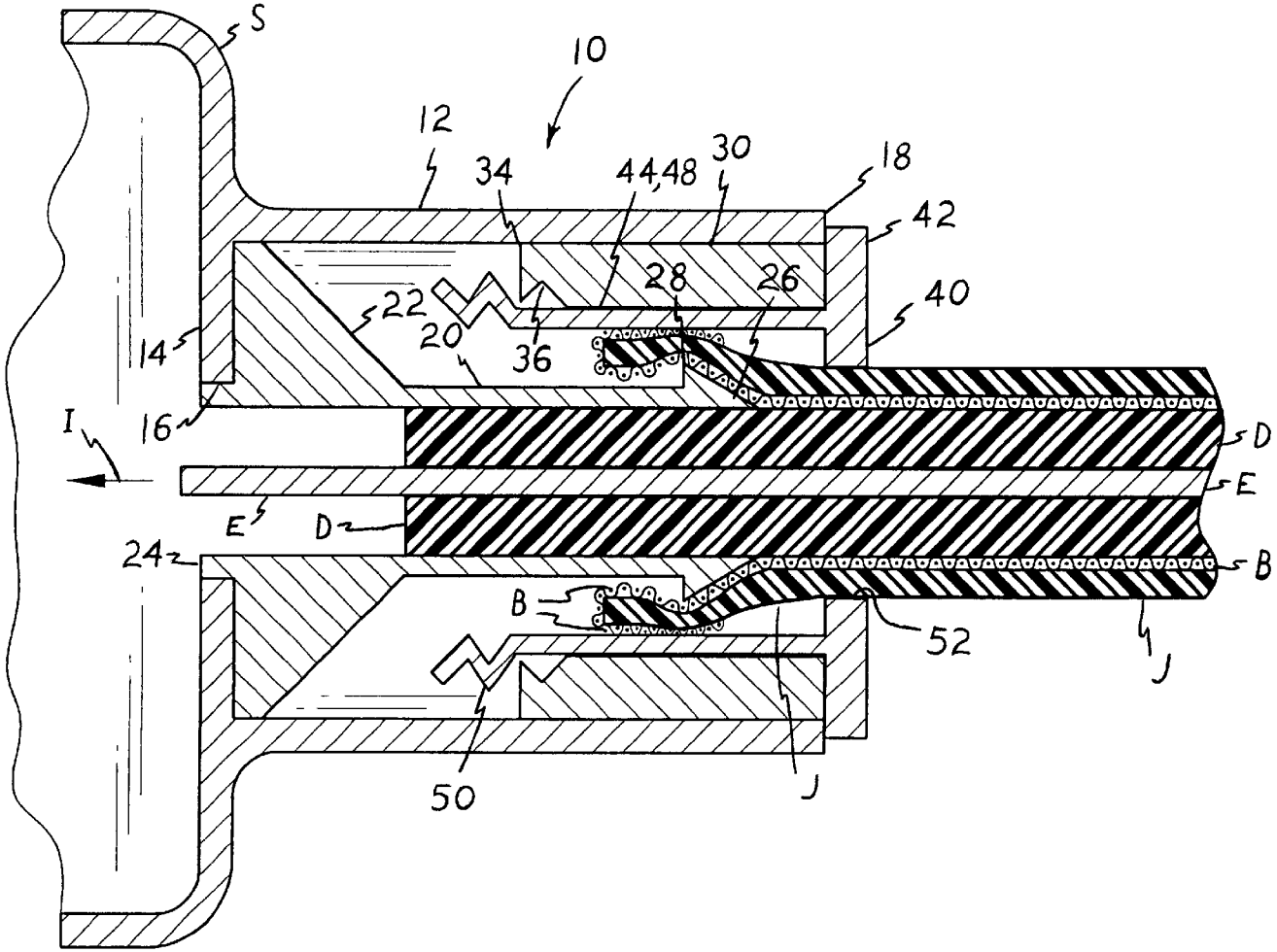
FIG. 2 is a side elevation view in section of the present quick connector, showing the initial step in the installation of a coaxial cable therein.
Figure 3:
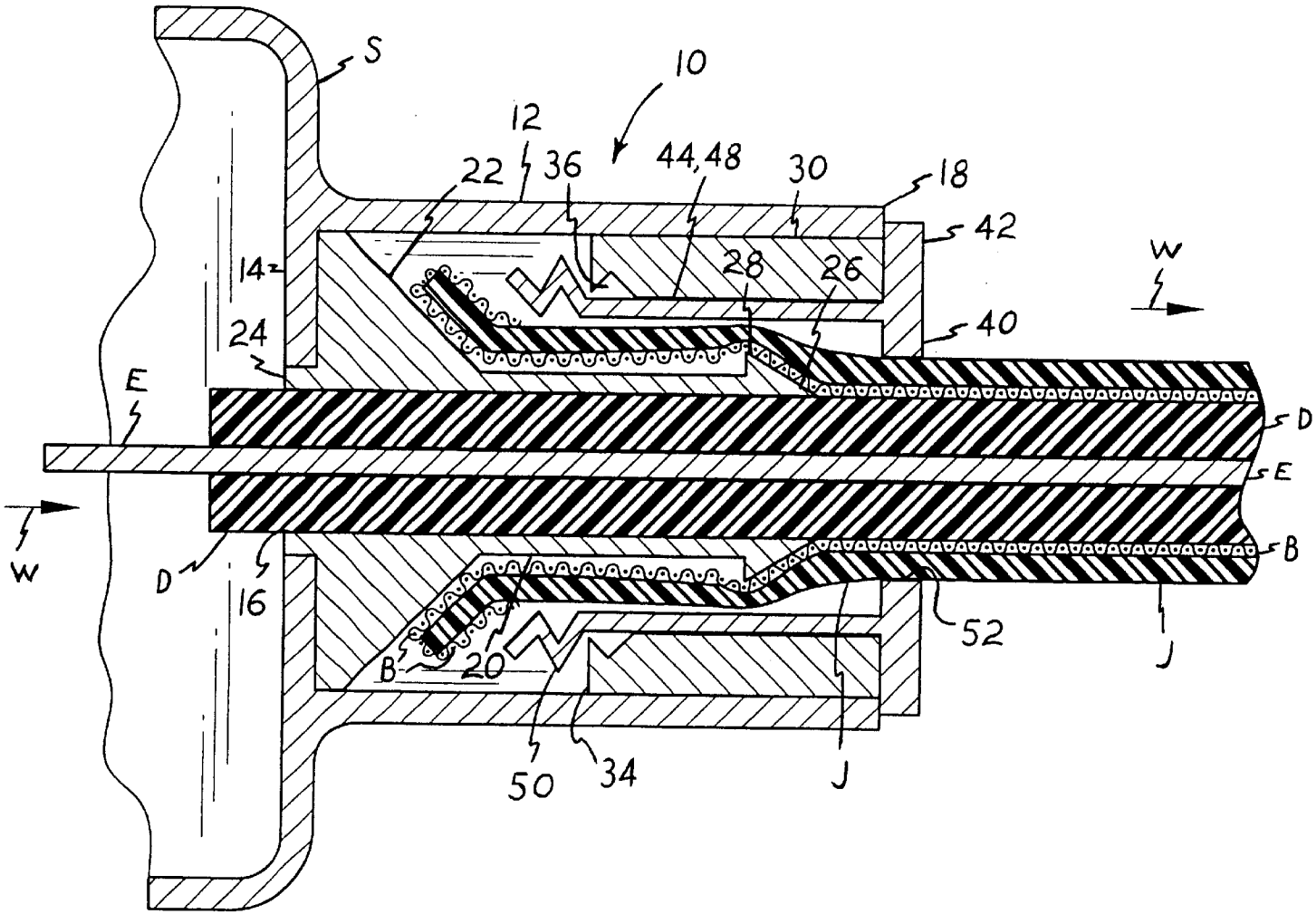
FIG. 3 is a side elevation view in section similar to FIG. 2, but showing the complete insertion of the cable in the connector.
Figure 4:
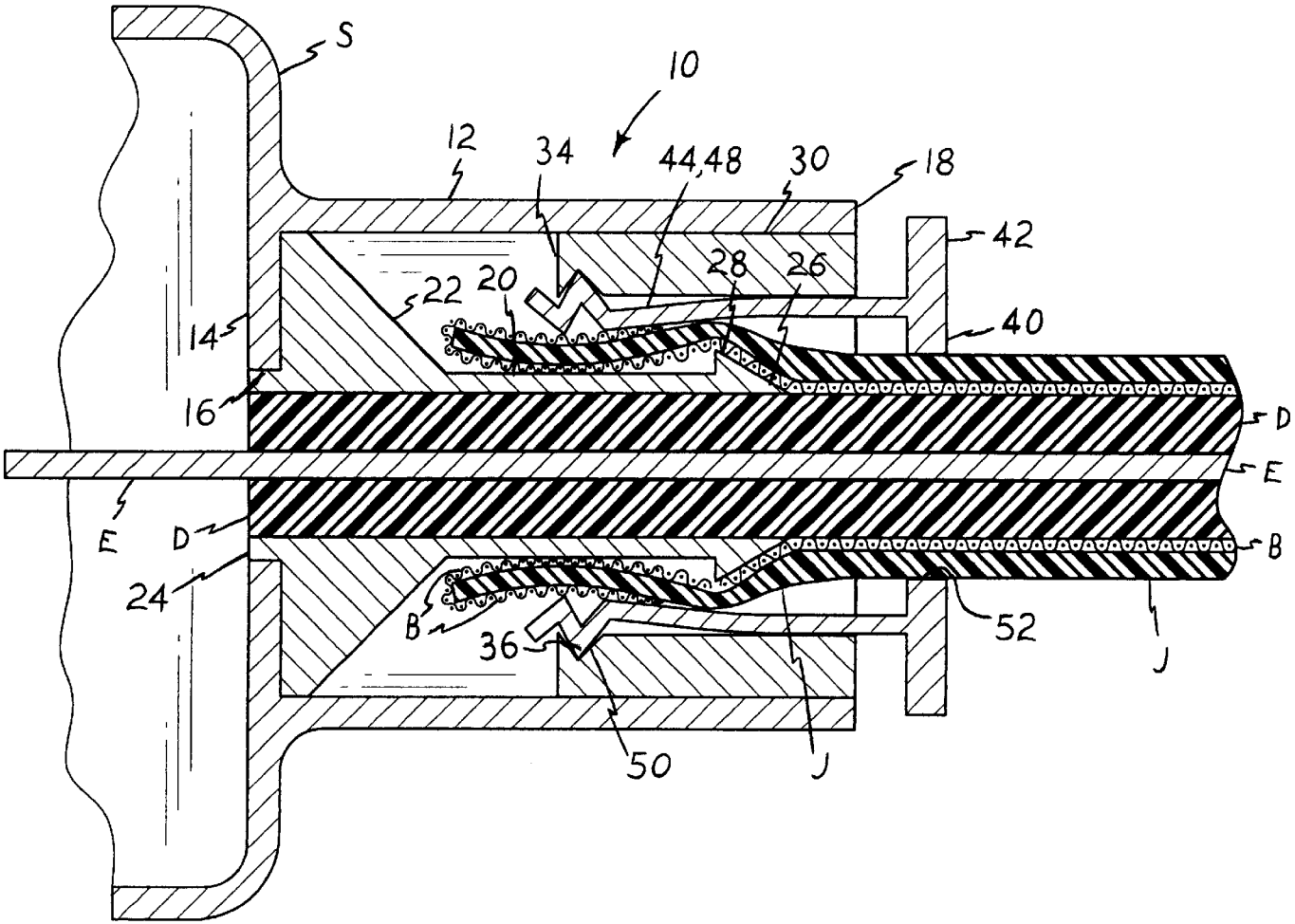
FIG. 4 is a side elevation view in section of the connector of FIGS. 2 and 3, illustrating the slight withdrawal of the cable and locking of the retainer to lock the cable in the connector, completing the installation process.

FIGS. 2 through 4 illustrate the installation of a coaxial cable C into the connector 10. The coaxial cable C used with the present connector 10 is conventional, having an inner electrical conductor wire E concentrically surrounded by a dielectric material D, an electrically conductive shield braid B surrounding the dielectric D, with the above components in turn being wrapped in an electrically insulating outer jacket J. The coaxial cable C used with the present connector 10 is "bare," i.e., does not require any form of separate connector or other componentry to be installed upon the cable end before insertion into the connector 10, as is generally required of most other coaxial cable installations. Rather, the bare cable C need only be cut and trimmed to fit the connector 10, by cutting the jacket J, shielding braid B. and dielectric D to expose a length (e.g., one quarter inch or so) of the central electrical conductor E, removing a further portion (e.g., one half inch or so) of the outer jacket material J, and folding the shielding braid B back over the outer jacket J to expose a corresponding length of the dielectric D, as shown.

At this point, the trimmed end of the cable C is inserted into the retainer 40 disposed within the collar 30 in the open end 18 of the housing 12, generally as shown in FIG. 2 of the drawings. The retainer flange 42 has a concentric passage 52 therethrough adapted to closely fit the coaxial cable C assembly. The cable C is pushed., on into the inner body 20, to push the electrical conductor E toward the end wall passage 16 to engage the cable conductor receiver (not shown) within the shell S of the electronic device.

It will be noted in FIGS. 2 and 3 that the flange 42 of the retainer 44 is pushed inwardly to lie in contact with the cable insertion end 18 of the outer housing 12, and corresponding end of the collar 30. This results in the ridges 50 of the retainer fingers 48 extending beyond the internal groove 36 of the collar 30, allowing the fingers 48 to spread radially against the inner diameter 38 of the collar 30. As the inner diameter 38 of the collar 30, and inner diameter between the fingers 48 of the retainer 40, is somewhat larger than the diameter of the coaxial cable assembly C, clearance is provided for the shielding braid B and outer jacket J of the coaxial cable C as it is inserted within the connector 10, as described below.

FIG. 2 also discloses that the combination of the inner diameter of the inner body 20, configured to fit closely about the diameter of the dielectric D of the cable C, and the sharpened cable engagement end 26 of the inner body 20, results in the shielding braid B and outer jacket J being separated from the dielectric sleeve D contained therein. Thus, only the dielectric D and its concentrically contained central electrical conductor E pass through the tubular center of the inner body 20. The outer jacket J and shielding braid B of the cable C passes around the outside of the tubular inner body 20, while the dielectric D and central electrical conductor E pass through the core or interior of the inner body 20, with the hollow core of the inner body 20 guiding the dielectric D and electrical conductor E through the inner body flange 24 and surrounding housing end wall passage 16.

The outward flexure of the retainer fingers 48 against the inner surface of the collar 30, also provides room for the cable jacket J and shielding braid B to pass between the barbed end 28 of the inner body 20 and the inner surfaces of the retainer fingers 48. This permits the cable C to be pushed into the connector 10 in the direction of the insertion arrow I (FIG. 2), without undue exertion by the installer. The primary force required is to overcome the resistance of the separation of the shielding braid B and outer jacket J from the inner dielectric D of the coaxial cable C. The insertion of the cable C into the connector 10 also results in some frictional force being applied to the retainer 40, urging it into the connector 10 in the position shown in FIGS. 2 and 3, where it applies little or no retaining force to the cable C.

In FIG. 3 of the drawings, the coaxial cable C has been pushed into the quick connector 10 until the end of the dielectric D has passed through the entire length of the inner body 20, to extend through the end wall passage 16 of the case or shell S of the electronic device from which the present quick connector 10 extends. This causes the exposed end of the central electrical conductor E to be inserted into the conventional conductor receptacle (not shown) within the shell S of the electronic device, to make electrical contact therewith, and complete the electrical circuit. Greater resistance to cable insertion is provided by the conical end 22 of the inner body 20 as the cable jacket J and shielding braid B ride outwardly thereover, thus precluding excessive insertion of the cable C into the electronic device.

At this point, the coaxial cable C is withdrawn slightly from its deepest insertion point, as shown by the withdrawal arrows W of FIG. 3, to assume its finally installed position as shown in FIG. 4 of the drawings. This slight withdrawal of the cable C places the trimmed end of the dielectric substantially even with the end of the flange 24 of the inner body 20, and thus even with the inner surface of the case or shell S of the electronic device. The length of the exposed central electrical conductor E still provides sufficient electrical contact with the unshown receptacle, to provide good electrical signal transferral from the cable C to the electronic device to which the cable C has been connected. This slight withdrawal of the cable C also results in locking the cable C within the connector 10 by several means, as described below.

The retainer 40 of the present quick connector 10 provides cable capturing means to hold the cable C securely within the connector 10, by means of the interaction between the retainer fingers 48 and collar 30. As the cable C is withdrawn slightly from its slightly overinserted position shown in FIG. 3, the cable withdrawal simultaneously tends to draw the retainer 40 outwardly from the housing 12; some assistance may be provided by the cable installer by pulling outwardly on the flange 42 of the retainer 40, if required. This withdrawal of the retainer 40, results in the circumferential ridges 50 of the retainer fingers 48 being displaced inwardly (i.e., toward the axis of the cable C and connector 10) as they ride over the ridge at the inner end 34 of the collar 30 and then seat within the groove 36 of the collar 30.

As the groove 36 is relatively shallower than the height of the ridges 50, the retainer fingers 48 are held in an inwardly displaced position relative to their position when the retainer 40 is fully inserted into the housing 12 in the position shown in FIGS. 2 and 3 of the drawings. This inward displacement of the fingers 48 is clearly evident due to the gap between the fingers 48 and the inner surface of the collar 30, as shown in FIG. 4 of the drawings. This results in the distal ends of the fingers 48 applying a strong radially inward gripping pressure against the end of the outer jacket J and folded over shielding braid B of the coaxial cable C, capturing this portion of the jacket J and braid B between the ends of the fingers 48 and the outer surface of the tubular inner body 20. The retainer 40 is locked into this position until it is positively moved therefrom, by means of the engagement of the finger ridges 50 in the mating groove 36 of the collar 30.

The inner body 20 of the assembly also provides positive cable capturing means, due to the orientation of the sharpened cable engagement end 26 and adjacent circumferential barb 28 of the inner body 20. When the cable C is withdrawn slightly from the connector 10, the material of the shielding braid B catches on the back of the barb 28 to preclude further withdrawal of the cable C. The inward flexure of the fingers 48 also urges them closer to the barb 28, thereby applying greater pressure to the jacket J and shielding braid B material between the fingers 48 and barb 28, to provide additional retention for the coaxial cable C.

The above described positive retention of the coaxial cable C within the conductor 10, results in very positive contact between the cable shielding braid B and both the inner body 20 (along the tube and at the barb 28) and the inner surfaces of the retainer fingers 48 as they contact the folded back portion of the shielding braid B. Preferably, the various components of the connector 10 (the housing 12, inner body 20, collar 30, and retainer 40) are formed of some form of electrically conductive material (steel, etc.), in order to provide a good ground between the shielding braid B and the chassis or shell S of the electronic device from which the housing 12 extends. Thus, installation of the cable C in the present quick connector 10, automatically grounds the braided shield B of the cable C to the shell S of the electronic device.

It will be seen that the above described connector 10, and capture of the end of a trimmed bare coaxial cable C therein, provides positive retention of the end of the cable C without requirement for any tools or other equipment, other than the cutting tools required to trim the end of the coaxial cable C. However, the present quick connector 10 does not necessarily provide an irreversible attachment for the end of the cable C. The process of installing the cable C in the connector 10 may be reversed, if so desired, to allow removal of the cable C from the connector 10 with little, if any, damage to the cable C. The present connector 10, and coaxial cable C installed therewith, may be connected and disconnected from one another innumerable times without undue harm to the end of the cable C.

The removal of the cable C from the connector 10 is accomplished essentially by reversing the installation steps described above. First, the coaxial cable C is pushed slightly inwardly, i.e., toward the position of its farthest insertion during the installation process, generally as shown in FIG. 3. The cable C will tend to move the retainer 40 toward its retracted position as shown in FIGS. 2 and 3 as well, during this momentary insertion step. If the retainer 40 does not automatically retract with insertion of the cable C, some pressure may be applied to the retainer flange 42 to retract the retainer 40 into the housing 12.

The insertion of the cable C into the housing 12, and retraction of the retainer 40 into the housing 12, provides two different actions which serve to loosen the grip of the housing assembly on the cable C. First, further cable insertion results in disengaging the shielding braid B from the edges of the barb 28 of the inner body 20. Secondly, retracting the retainer 40 causes the fingers 48 to retract further into the housing 12, thus causing the finger ridges 50 to ride out of the mating groove 36 of the collar 30, returning to their positions as shown in FIGS. 2 and 3 where they remain generally parallel to the axis of the connector 10 and are not deflected inwardly. This releases the radially inward pressure on the end of the insulating jacket J and folded shielding braid B of the end of the cable C, thus allowing the cable C to be withdrawn easily from the connector 10. While the braid B may be somewhat crimped by the installation process, it is not appreciably damaged, and the cable C may be reinstalled as desired.

In conclusion, the present quick connector 10 provides for the installation (and subsequent removal, as desired) of a conventional coaxial cable to an electronic device, without any requirement for assembly of the connector or any components thereof, or assembly of any fittings to the end of the cable, or any tools whatsoever once the cable end has been trimmed as required. The present quick connector is preferably manufactured integrally with the electronic device to which the cable is to be installed, in order to obviate any requirement for the assembly of any connector components to the electronic device itself. While the present quick connector has been described in use with various electronic devices, it will be seen that it may also be constructed as a laterally symmetrical unit for use in connecting two cables end to end, to form an inline cable splice, if so desired. The present disclosure is not limiting to the types of electronic devices which may incorporate the present quick connector.

While the present quick connector has been shown with conventional RG-59 coaxial cable, it will be seen that it is readily adaptable for use with other types of coaxial cable having different diameters, e.g., RG-6, RG-7, RG-11, multiple shield cable, etc., as desired. The basic principle of construction and operation remains the same, and provides significant benefits in time and labor savings for both the professional and amateur cable installer alike, resulting in significant economies in professional cable installations in the field and considerably higher success rates for cable installations by the do-it-yourself installer.

It is to be understood that the present invention is not limited to the sole embodiment described above, but encompasses any and all embodiments within the scope of the following claims.

I claim:

1. A quick connector for removably securing a coaxial cable to an electronic device, with the coaxial cable having a center conductor, a dielectric concentrically surrounding the inner conductor, a conducting braided shield concentrically surrounding the dielectric, and an outer electrically insulating jacket concentrically surrounding the conducting shield, the quick connector comprising:

a generally cylindrical housing permanently and integrally formed with the electronic device and extending therefrom;

said housing having an electronic device end wall with a cable passage formed therethrough, and an open cable insertion end; opposite said electronic device end wall;

a generally tubular inner body permanently and immovably disposed concentrically within said housing, adjacent said electronic device end wall;

a cylindrical collar permanently and immovably affixed concentrically within said cable insertion end of said housing; and a retainer disposed concentrically within said collar, said retainer being axially movable and having locking means for locking against said collar to prevent removal of said retainer from said collar.

2. The quick connector according to claim 1, further including:

an electronic device end flange extending from said inner body, and disposed concentrically within said cable passage of said electronic device end wall of said housing.

3. The quick connector according to claim 1, wherein:

said inner body has an inner diameter substantially equal to the diameter of the dielectric of the coaxial cable; and a circumferentially sharpened coaxial cable engagement end extends from said inner body, opposite said electronic device end flange thereof, for penetrating between the dielectric and the shielding of the cable when the cable is inserted into said housing.

4. The quick connector according to claim 1, further including:

a barb circumferentially disposed about said coaxial cable engagement end of said inner body, for engaging the conducting shield of the coaxial cable and precluding inadvertent withdrawal of the coaxial cable from said housing.

5. The quick connector according to claim 1, wherein:

said retainer has an external flange with a generally cylindrical sleeve extending therefrom, the sleeve having a plurality of slots formed therethrough, defining a corresponding plurality of radially flexible fingers therebetween and extending from said flange of said retainer.

6. The quick connector according to claim 5, further including:

an outwardly disposed ridge formed circumferentially across each of said fingers of said sleeve of said retainer; and wherein said collar includes an inwardly disposed, circumferential groove formed therein, for selectively engaging each said ridge of said fingers of said sleeve of said retainer.

7. The quick connector according to claim 1, wherein said housing, said inner body, said collar, and said retainer are each formed of an electrically conductive material.

8. An electronic device and a quick connector for removably securing a coaxial cable thereto, with the coaxial cable having an inner conductor, a dielectric concentrically surrounding the inner conductor, a conducting shield concentrically surrounding the dielectric, and an outer electrically insulating jacket concentrically surrounding the conducting shield, the electronic device and quick connector comprising in combination:

an electronic device case for containing electronic componentry and for accepting electronic input from at least the coaxial cable;

a generally cylindrical housing permanently and integrally formed with said electronic device case and extending therefrom;

said housing having an electronic device end wall in common with said electronic device case with a cable passage formed therethrough, and an open cable insertion end opposite said electronic device end wall;

a generally tubular inner body permanently and immovably disposed concentrically within said housing, adjacent said electronic device end wall;

a cylindrical collar permanently and immovably affixed concentrically within said cable insertion end of said housing; and a retainer axially movably disposed concentrically within said collar.

9. The electronic device and quick connector combination according to claim 8, further including:

an electronic device end flange extending from said inner body, and disposed concentrically within said cable passage of said electronic device end wall of said housing and said electronic device.

10. The electronic device and quick connector combination according to claim 8, wherein:

said inner body has an inner diameter substantially equal to the diameter of the dielectric of the coaxial cable; and a circumferentially sharpened coaxial cable engagement end extends from said inner body, opposite said electronic device end flange thereof, for penetrating between the dielectric and the shielding of the cable when the cable is inserted into said housing.

11. The electronic device and quick connector combination according to claim 8, further including:

a barb circumferentially disposed about said coaxial cable engagement end of said inner body, for engaging the conducting shield of the coaxial cable and precluding inadvertent withdrawal of the coaxial cable from said housing.

12. The electronic device and quick connector combination according to claim 8, wherein:

said retainer has an external flange with a generally cylindrical sleeve extending therefrom, the sleeve having a plurality of slots formed therethrough, defining a corresponding plurality of radially flexible fingers therebetween and extending from said flange of said retainer.

13. The electronic device and quick connector combination according to claim 12, further including:

an outwardly disposed ridge formed circumferentially across each of said fingers of said sleeve of said retainer; and wherein said collar has inwardly disposed, circumferential groove formed therein, for selectively engaging each said ridge of said fingers of said sleeve of said retainer.

14. The electronic device and quick connector combination according to claim 8, wherein at least said housing, said inner body, said collar, and said retainer are each formed of an electrically conductive material.

15. A method of removably installing a bare coaxial cable to an electronic device, comprising the steps of:

(a) providing a coaxial cable having an inner conductor, a dielectric concentrically surrounding the inner conductor, a conducting shield concentrically surrounding the dielectric, and an outer electrically insulating jacket concentrically surrounding the conducting shield;

(b) further providing an electronic device having a case for containing electronic componentry and for accepting electronic input from at least the coaxial cable;

(c) further providing a generally cylindrical housing permanently and integrally formed with the electronic device case and extending therefrom, with the housing having an electronic device end wall in common with the electronic device case with a cable passage formed therethrough, and an open cable insertion end opposite the electronic device end wall;

(d) further providing a generally tubular inner body permanently and immovably disposed concentrically within the housing, adjacent the electronic device end wall, with the inner body having an inner diameter substantially equal to the diameter of the dielectric of the coaxial cable and a circumferentially sharpened coaxial cable engagement end opposite the electronic device end wall;

(e) further providing a cylindrical collar permanently and, immovably affixed concentrically within the cable insertion end of the housing;

(f) further providing a retainer axially movably disposed concentrically within the collar;

(g) further providing cable capturing means for the retainer;

(h) further providing cable capturing means for the inner body;

(i) further providing retainer locking means in the housing;

(j) trimming the coaxial cable and exposing a length of the inner conductor;

(k) further trimming the coaxial cable by removing a portion of the outer insulating jacket;

(l) folding the conducting shield back over the outer insulating jacket, and exposing a portion of the dielectric;

(m) inserting the trimmed end of the coaxial cable into the retainer;

(n) pushing the coaxial cable past the inner body, and, separating the dielectric from the conducting shield as the dielectric and inner conductor pass through the tubular inner body and the conducting shield and outer insulating jacket pass around the tubular inner body;

(o) extending the dielectric of the coaxial cable slightly through the cable passage of the end wall of the housing; and (p) slightly withdrawing the coaxial cable from the housing and simultaneously slightly withdrawing the retainer from the housing, thereby locking the coaxial cable within the housing by the cable locking means of the retainer.

16. The method of removably installing a bare coaxial cable to an electronic device according to claim 15, wherein the step of providing cable capturing means for the retainer, further includes the steps of:

(a) forming the retainer with an external flange with a generally cylindrical sleeve extending therefrom;

(b) further forming a plurality of slots in the sleeve of the retainer, and defining a corresponding plurality of radially flexible fingers therebetween and extending from the flange of the retainer;

(c) further forming an outwardly disposed ridge formed circumferentially across each of the fingers of the sleeve of the retainer;

(d) further forming an inwardly disposed, circumferential groove within the collar; and (e) slightly withdrawing the retainer from the housing, thereby flexing the fingers of the retainer inwardly and capturing the conducting shield and outer insulating jacket of the coaxial cable between the fingers of the retainer and the inner body.

17. The method of removably installing a bare coaxial cable to an electronic device according to claim 15, wherein the step of providing retainer locking means comprises engaging each ridge of the fingers of the sleeve of the retainer with the groove of the collar.

18. The method of removably installing a bare coaxial cable to an electronic device according to claim 15, wherein the step of providing cable capturing means for the inner body, further includes the steps of:

(a) forming a circumferential barb around the coaxial cable engagement end of the inner body; and (b) slightly withdrawing the coaxial cable from the housing, thereby catching the conducting shield of the coaxial cable upon the barbs of the coaxial cable engagement end of the inner body.

19. The method of removably installing a bare coaxial cable to an electronic device according to claim 15, further including the steps of:

(a) pushing the coaxial cable slightly inwardly into the housing, thereby disengaging the cable capturing means of the inner body;

(b) pushing the retainer slightly inwardly into the housing, thereby disengaging the retainer locking means and the cable capturing means of the retainer;

(c) holding the retainer in an inwardly disposed position to free the capture of the coaxial cable therefrom; and (d) withdrawing the coaxial cable from the housing.

20. The method of removably installing a bare coaxial cable to an electronic device according to claim 15, further including the step of forming at least the housing, the inner body, the collar, and the retainer of an electrically conductive material.

* * * * *